US008573103B2

(12) United States Patent
Arterburn et al.

(10) Patent No.: US 8,573,103 B2
(45) Date of Patent: Nov. 5, 2013

(54) FIBER CHOPPER

(75) Inventors: Russell Donovan Arterburn, Athens, TN (US); Michael David Folk, Oregon, OH (US)

(73) Assignee: Johns Manville, Denver, CO (US)

( * ) Notice: Subject to any disclaimer, the term of this patent is extended or adjusted under 35 U.S.C. 154(b) by 1081 days.

(21) Appl. No.: 11/330,547

(22) Filed: Jan. 11, 2006

(65) Prior Publication Data

US 2007/0158481 A1 Jul. 12, 2007

(51) Int. Cl.
*B23D 15/00* (2006.01)

(52) U.S. Cl.
USPC ..... 83/436.1; 83/698.41; 83/658; 83/659

(58) Field of Classification Search
USPC ..... 83/436.1, 913, 950, 347, 698.31, 83/698.41, 698.51, 436.15, 436.3, 437.4, 83/348, 558, 658, 659; 492/43, 44, 45, 51
See application file for complete search history.

(56) References Cited

U.S. PATENT DOCUMENTS

| | | | | | |
|---|---|---|---|---|---|
| 1,143,419 | A | * | 6/1915 | McKenna | 492/25 |
| 1,384,806 | A | * | 7/1921 | Reed | 492/45 |
| 1,408,327 | A | * | 2/1922 | Wilson et al. | 492/45 |
| 1,718,415 | A | * | 6/1929 | Gowans | 492/18 |
| 1,780,455 | A | * | 11/1930 | Apple | 492/45 |
| 2,183,722 | A | * | 12/1939 | Newman | 83/345 |
| 2,745,491 | A | * | 5/1956 | Sonneborn et al. | 83/98 |
| 3,304,821 | A | * | 2/1967 | Matino et al. | 83/26 |
| 3,426,414 | A | * | 2/1969 | Iseki et al. | 492/27 |
| 3,508,461 | A | | 4/1970 | Stream | |
| 3,763,532 | A | * | 10/1973 | Smith | 492/45 |
| 3,869,268 | A | | 3/1975 | Briar et al. | |
| 4,083,279 | A | | 4/1978 | Wester et al. | |
| 4,220,064 | A | * | 9/1980 | Potter | 83/665 |
| 4,249,441 | A | | 2/1981 | Sturtz | |
| 4,287,799 | A | | 9/1981 | Fujita et al. | |
| 4,398,934 | A | | 8/1983 | Willis et al. | |
| 4,583,437 | A | * | 4/1986 | Rader et al. | 83/304 |
| 5,906,149 | A | * | 5/1999 | Montenegro Criado | 83/659 |
| 5,970,837 | A | | 10/1999 | Arterburn et al. | |
| 6,029,552 | A | * | 2/2000 | Harris | 83/13 |
| 6,619,573 | B2 | | 9/2003 | Arterburn et al. | |
| 7,832,315 | B2 | | 11/2010 | Bascom et al. | |
| 2008/0115537 | A1 | | 5/2008 | Font et al. | |
| 2008/0210071 | A1 | | 9/2008 | Font et al. | |
| 2009/0205469 | A1 | | 8/2009 | Font et al. | |

* cited by examiner

*Primary Examiner* — Omar Flores Sanchez
(74) *Attorney, Agent, or Firm* — Robert D. Touslee

(57) ABSTRACT

A method and apparatus for chopping long unwound items like fiber, fiber strands, yarn, etc. The chopper has a backup roll comprising a wheel and a working layer on the outer peripheral surface of the wheel and an engaging blade roll. The outer peripheral surface of the wheel contains spiral grooves or ridges that mate with ridges or grooves on an inner peripheral surface of the working layer such that a worn working surface can be quickly and easily unscrewed from the wheel and a new working surface can be quickly and easily screwed into place, making the job of replacing the working surface faster, easier and less costly than prior art practice.

21 Claims, 2 Drawing Sheets

FIBER CHOPPER

BACKGROUND

The present invention involves an improved chopper for chopping continuous or very long loose items such as fiber, fiber strands, yarn, wire, string, ribbon, tape and the like by pulling the item(s) into the chopper while the loose items are held tightly against the surface of a rotating backup roll and carrying the item(s) on into a nip between a rotating blade roll and the rotating backup roll where they are separated into short pieces. More specifically the present invention involves a chopper having an improved backup roll and methods of making and using the improved backup roll.

It has long been known to chop continuous fibers or fiber strands into short lengths of about 5 inches or shorter. Billions of pounds of such product including chopped glass fibers and fiber strands are produced each year in process and chopping apparatus such as disclosed in U.S. Pat. Nos. 5,970,837, 4,398,934, 3,508,461, and 3,869,268, the disclosures of which are incorporated herein by reference. The choppers disclosed in these patents comprise a blade roll containing a plurality of spaced apart blades for separating the fibers into short lengths, a backup roll, often driven, having a working surface that the blades work against to effect the separation, and that also pulls the fibers or fiber strands. In the processes disclosed in these patents, the chopper is usually the most productivity limiting equipment in the processes. These processes typically operate continuously every day of the year, 24 hours each day, except during furnace rebuilds every few years. Therefore, improvements in the chopper, that allow the chopper to pull and chop faster and for longer times between maintenance shutdowns, and to have shorter duration shutdowns for maintenance have an extremely positive impact on productivity and production costs.

The working surface layer of the backup roll is a somewhat soft material that starts out about two inches thick. During operation the surface of the working surface layer becomes rough because of the blades penetrating the surface repeatedly to break or chop the strands of fibers into desired lengths. When the surface roughness becomes too severe, some of the fibers in the strands are not chopped and this produces double cuts, long cuts, uncuts, etc., i.e. fibers longer than the desired length and multiples of the spacing between the blades, which is undesirable and causes scrap and defects in the products the fibers are used to make, such as nonwoven webs, composites, etc. Prior to such a condition developing to a costly extent, the surface of the working surface layer is ground down in place on the chopper, or the backup roll, or working surface layer are removed and ground down off-line.

It has been typical to remove the entire backup roll to do this, but more recently it has also been taught to remove only the working surface layer, see U.S. Pat. No. 6,619,573. The backup rolls are very heavy on most choppers requiring two workers and lifting aids, or one worker and a precise lifting aid to change the backup roll quickly, i.e. within 5-10 minutes. The fiber forming rooms where the choppers operate are typically crowded and it is not practical or desirable to have to bring in bulky equipment to provide lifting aid for a new or reconditioned backup roll. The working surface layer is much lighter and can easily be lifted and placed by one worker. To reduce downtime significantly it is taught in U.S. Pat. No. 6,619,573 to use a collapsible mandrel as the wheel for the backup roll and to replace only the working surface layer. This solution works well, but requires replacement of all the existing wheels with a collapsible wheel that is more costly than a standard wheel.

Normally several strands such as up to 14 are fed into the chopper, each strand containing 2000 or more fibers. As more fiber strands and fibers are fed into the chopper it becomes more difficult to pull all of the strands and fibers at the same speed, so more pressure is applied to the cylinder pushing the idler roll against the backup roll with more force.

SUMMARY

The present invention is an improved chopper for separating long lengths of one or more unwound items selected from a group consisting of fibers, fiber strands, wires, strings, tape (s), strip(s) and ribbon(s) into short lengths. One or more of, preferably a plurality of, the long lengths of material are pulled into the chopper in an unwound form at speeds exceeding 1,000 FPM, usually at speeds exceeding 2000 FPM and often at speeds exceeding 3,000 FPM, by the peripheral surface of an elastomer working surface layer on the peripheral surface of a rotating wheel, the combination called a backup roll. The working surface layer of the backup roll carries the item(s) on into a nip between the working surface layer and a rotating blade roll. The improvement is a backup roll comprising a working surface layer that is threaded onto the wheel of the backup roll, more typically using either spiral grooves or ridges on the surface of the wheel of the backup roll. The item(s) being chopped can be either dry or wet with or without a chemical sizing on the surface of the item(s).

The invention also includes a method of chopping continuous fiber with a chopper having a blade roll comprising a plurality of spaced apart blades and a backup roll, the backup roll comprising a wheel having a peripheral surface and a working layer of elastomeric material on the peripheral surface, comprising feeding one or more fibers to the chopper and separating the one or more fibers into segments as they pass through a nip between the blade roll and the backup roll, replacing the working layer of the backup roll after it becomes worn, the improvement comprising using a wheel that has spiral grooves or ridges on the peripheral surface and a working layer that has an inner peripheral surface for mating with the peripheral surface of the wheel and replacing the working layer by unscrewing the worn working layer from the wheel and screwing a new working layer onto the wheel. Typically the grooves or ridges on the peripheral surface of the wheel can be oriented in either clockwise or counterclockwise direction, and if secured, such as with at least one retaining rim on the backside of the wheel, the working surface will tighten during operation and not tend to become unscrewed from the wheel. Instead of a retaining rim, the grooves in the wheel or in the inner surface of the working layer could stop short of the back side of the wheel or working layer to prevent the working layer from threading itself past the backside of the wheel.

When the word "about" is used herein it is meant that the amount or condition it modifies can vary some beyond that so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without unexpected characteristics, those embodiments are within the meaning of the term about as used herein. It is not difficult for the skilled artisan or others to determine whether such an embodiment is either as might be expected or, because of either a break in the continuity of results or one or more features that are significantly better than reported by the inventor, is surprising and thus an unobvious teaching leading to a further advance in the art.

DETAILED DESCRIPTION OF THE INVENTION

Figure 1:
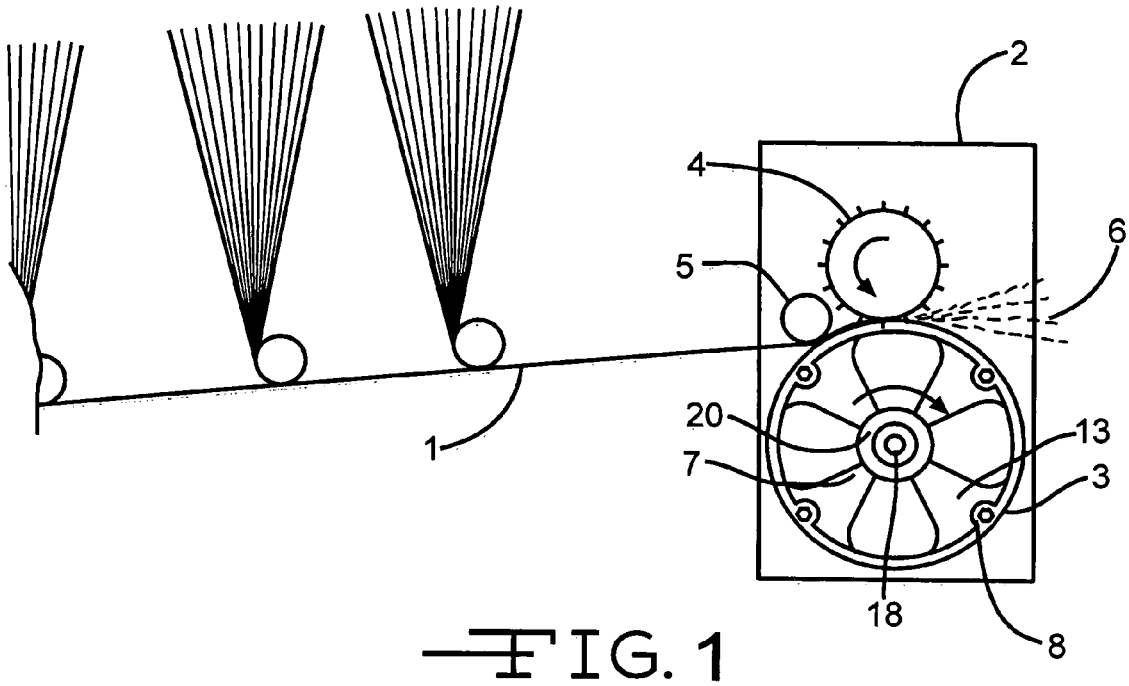
FIG. 1 (Prior Art)
FIG. 1 is a schematic view of a prior art fiberizing system comprising a chopper.

FIG. 1 shows an elevational schematic view of a typical prior art fiberizing system producing strands of fiber 1 being pulled by a chopper 2. The chopper 2 comprises a blade roll 4 with spaced apart blades (not shown) projecting from the periphery of the blade roll 4, a backup roll 7 and an idler roll 5, or having having one or more spaced apart spiral or curved blades. The blade roll 4 is mounted on a rotatable spindle (not shown). The blade roll 4 is often made of metal and an elastomeric material such as the blade rolls shown in U.S. Pat. Nos. 4,083,279, 4,249,441 and 4,287,799, the disclosures of which are herein incorporated by reference.

To operate the chopper of the type shown in FIG. 1, onne or more, usually eight or more and up to 20 or more fibers or strands 1, such as glass fiber strands, each strand containing 400-6000 or more fibers and usually having water and/or an aqueous chemical sizing on their surfaces, are pulled by the backup roll 7, in cooperation with a knurled idler roll 5, into the chopper 2 and between the nip. The working surface of the back up roll 7 is typically wider than the oscillating path of the glass fiber strands 1. The strands remain on the surface of the working layer 9 and next pass into the nip between the backup roll 7 and the blade roll 4 where they are separated with the razor sharp blades of the blade roll 4.

Figure 2:
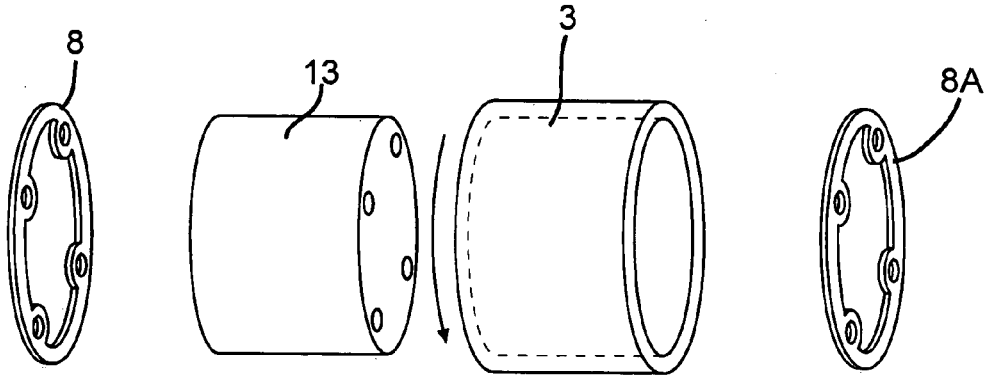
FIG. 2 (Prior Art)
FIG. 2 is an exploded schematic view of a prior art backup roll.

The backup roll 7 is supported by a spindle 18, and as shown by FIG. 1 and FIGS. 1,2,and 12 and the description thereof of U.S. Pat. No. 5,970,837 incorporated herein above, the spindle 18 is supported only on an end portion closest to a drive for the chopper 2, the backup roll 7 is comprised of a wheel 13 a working or surface layer 3 and two metal retaining rims 8 and 8A. The working surface layer 3, often urethane, is cast or force mounted on the outer periphery of the wheel 13 and held in place with retaining rims 8 and 8A bolted onto the wheel 13. The backup roll 7 is mounted on the spindle 18 and held in place with a large nut 20. The backup roll assembly 7 is very heavy, typically about 50-90 or more pounds, because of its large size, more than 30 inches in diameter and at least 4-6 inches or more wide, and because of the weight of the metal wheel 13. Currently it must be removed from the chopper and carried to a location outside the fiber forming room to enable the worn working layer 3 to be removed and replaced with a new working layer 3. This not only increases the lost production time for the leg of bushings that the chopper services, but also causes more upset and resultant lower productivity for at least 20 minutes after the chopper is restarted and the leg is again producing desired product.

Figure 3:
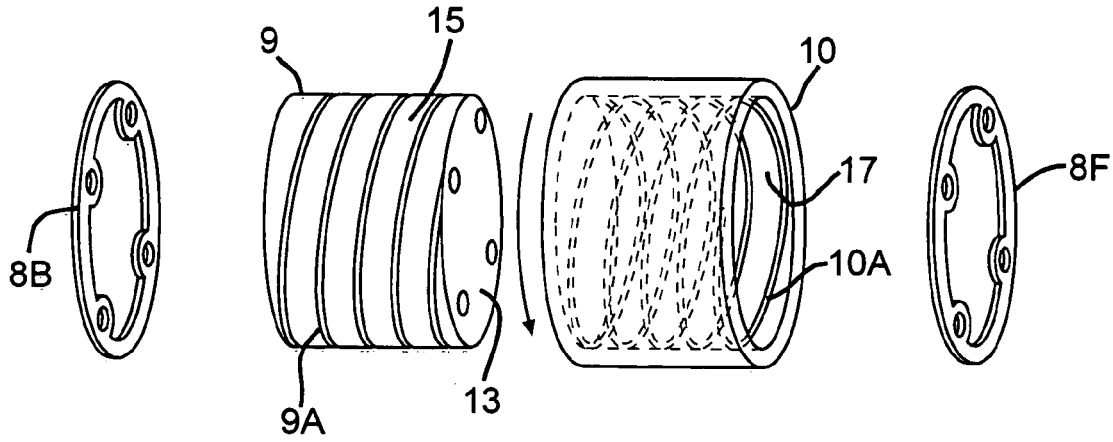
FIG. 3 is an exploded schematic view of a backup roll of the present invention.
Figure 4:
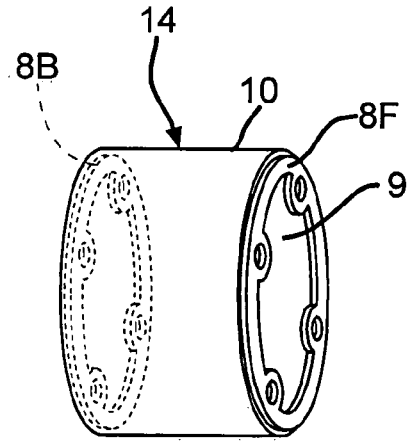
FIG. 4 is a schematic view of a backup roll of the present invention.

An embodiment of the backup roll 14 of the present invention is illustrated in FIGS. 3 and 4 and comprises a wheel 9, like the wheel 13, but having spaced apart spiral oriented grooves or ridges 9A on its outer peripheral surface 15 and a separate working surface layer 10 having grooves or ridges 10A on an inner peripheral surface 17, the grooves or ridges 10 A being a mirror image or an offset profile of the grooves or ridges 9A. The working layer 10 is relatively lightweight, typically weighing about 15-25 pounds. When the outer peripheral surface 15 of the wheel 9 contains ridges 9A, the inner peripheral surface 17 of the working layer 10 will contain grooves 10A. When the outer peripheral surface 15 of the wheel 9 contains grooves 9A, the inner peripheral surface 17 of the working layer 10 will contain ridges 10A. The grooves or ridges 9A and the grooves or ridges 10A permit the working layer 10 to be rotated onto, screwed onto, the outer peripheral surface 15 of the wheel 9, an optional stop rim or ring 8B acting as a stop or seat for a back edge of the working layer 10. The grooves or ridges 9A, 10A can be one or more continuous spirals or a plurality of continuous spirals.

Figure 5:
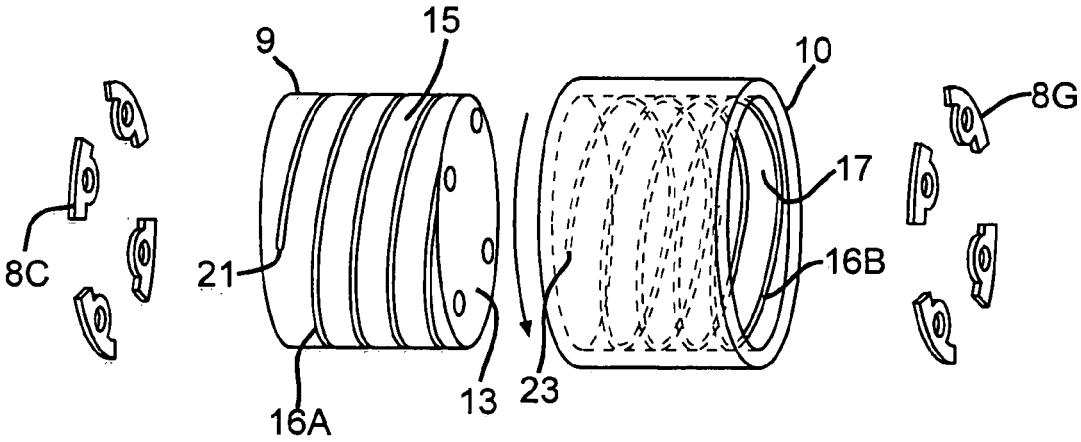
FIG. 5 is an exploded schematic view of other backup roll embodiments of the present invention.

The wheel 9 can have an optional stop surface extending outward from the outer peripheral surface of the wheel on the side of the wheel closest to a drive for the chopper. The purpose of the stop surface is to prevent the working layer 10 from rotating too far so that its leading side goes past the chopper drive side edge of the surface 15 of the wheel 9. The stop surface can be continuous around the periphery of the wheel 9 as shown in FIGS. 3 and 4, or can be intermittent with two or more connected or separate stops 8C as shown in FIG. 5. A stop ring 8B is optional because it is unnecessary when the spiral grooves or ridges end before reaching the back edge of the working layer and outer peripheral surface of the wheel as shown at 21, 23 in FIG. 5.

In one direction of rotation, the grooves or ridges 9A, or 16A (FIG. 5) on the outer peripheral surface of the wheel 9 will tighten against the new working surface 10 and the new working surface 10 can tighten against the optional stop ring 8B, or one or more stops 8C, these being bolted or otherwise suitably attached to, or a part of, the wheel 9.

This embodiment will not require the optional retainer ring 8F or one or more retainers 8G (FIG. 5). Rotation opposite of the aforementioned will require the use of the optional retainer ring 8F since in this case the working surface 10 will tend back away from the optional stop ring 8B on the outer peripheral surface 15 of the wheel 9. In this case the optional retainer ring 8F is bolted to the wheel 9 after the new working surface 10 is screwed onto the wheel 9.

To operate the according to the invention, the chopper is shut down when the working layer 10 on the backup roll 14 becomes worn to the point it is not chopping thoroughly or is reaching that condition. The nip between the blade roll 4 and the backup roll 7 is opened up and the worn working layer 10 is unscrewed from the wheel 13 using a large, conventional strap wrench. A new working layer is then screwed onto the wheel 9, again using the large strap wrench. The replacement of the working layer 9 takes less than about 2 minutes, most typically only about 30-60 seconds (when the optional retainer ring 8F or 8G is not used) from the time the chopper is fully stopped and is again ready to start back up. Also, the heavy wheels 13 do not have to be removed and carried and the awkward and bulky equipment required to do this are no longer necessary in the fiber forming room unless a wheel 9 becomes damaged, a rare thing. The invention also prevents slippage between the outer surface of the wheel 9 and working layer 10. As heat increases during work, the previous working layer 3 would increase in diameter, reducing frictional engagement between the surface of the wheel 9 and working layer 3, sometimes permitting slippage. Also, the useful life of working layer 3 was reduced when it was stretched and stressed to fit over the outer surface of the wheel 9. This invention uses a minimum clearance between the inner surface of the working layer 10 and the outer surface of the wheel 9 thus eliminating internal stresses and maximizing useful life of the working layer.

Other embodiments employing the concept and teachings of the present invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A chopper for continuously separating long lengths of unwound item(s) selected from the group consisting of fibers, fiber strands, string, yarn, wire, tape and ribbon into short pieces as the unwound items pass into the chopper at speeds exceeding 1000 ft./minute comprising a rotatable backup roll having a continuous peripheral elastomer working layer on an outer peripheral surface of a wheel and a rotatable blade roll comprising a plurality of straight blades for contacting the peripheral working layer of the backup roll, the improvement comprising; spaced apart spiral grooves or ridges on the outer peripheral surface of the wheel and grooves or ridges on an inner surface of the peripheral elastomer working layer matching the pattern of the grooves or ridges on the outer peripheral surface of the wheel, the ridges engaging the grooves as the working layer is threaded into place on the wheel and wherein the wheel has a stop surface extending outward from the outer peripheral surface of the wheel on the side of the wheel closest to a drive for the chopper, the grooves and ridges being so arranged that the elastomer peripheral working layer can be threaded onto and off of the outer surface of said wheel.

2. The chopper of claim 1 wherein the stop surface is continuous around the wheel.

3. A chopper for continuously separating long lengths of unwound item(s) selected from the group consisting of fibers, fiber strands, string, yarn, wire, tape and ribbon into short pieces as the unwound items pass into the chopper at speeds exceeding 1000 ft./minute comprising a rotatable backup roll having a continuous, elastomer peripheral working layer on an outer peripheral surface of a wheel and a rotatable blade roll comprising a plurality of straight blades for contacting the peripheral working layer of the backup roll, the improvement comprising; spaced apart spiral grooves or ridges on the outer peripheral surface of the wheel and spaced apart spiral grooves or ridges on an inner surface of the peripheral working layer matching the pattern of the grooves or ridges on the outer peripheral surface of the wheel, none of said groves on the inner surface of the peripheral working layer extending to an outer peripheral surface of said peripheral working layer the ridges engaging the grooves as the working layer is threaded into place on the wheel, said grooves on the inner surface of the peripheral working layer extending only part way through a thickness of said peripheral working layer, the grooves and ridges being so arranged that the elastomer peripheral working layer can be threaded onto and off of the outer surface of said wheel and wherein the outer peripheral surface of the wheel comprises grooves thereon and the inner peripheral surface of the elastomer working layer has ridges thereon, and wherein the wheel has a stop surface extending outward from the outer peripheral surface of the wheel on the side of the wheel closest to a drive for the chopper.

4. The chopper of claim 3 wherein the orientation of the grooves and ridges are such that the working layer tends to tighten on the wheel due to the direction of rotation of the wheel during operation.

5. A chopper for continuously separating long lengths of unwound item(s)selected from the group consisting of fibers, fiber strands, string, yarn, wire, tape and ribbon into short pieces as the unwound items pass into the chopper at speeds exceeding 1000 ft./minute comprising a rotatable backup roll having a continuous peripheral elastomer working layer on an outer peripheral surface of a wheel and a rotatable blade roll comprising a plurality of straight blades for contacting the peripheral elastomer working layer of the backup roll, the improvement comprising; spaced apart spiral grooves on the outer peripheral surface of the wheel and ridges on an inner surface of the peripheral elastomer working layer matching the pattern of the grooves in the outer peripheral surface of the wheel, the ridges engaging the grooves as the working layer is threaded into place on the wheel, the grooves and ridges being so arranged that the elastomer peripheral working layer can be threaded onto and off of the outer surface of said wheel, and wherein the wheel has a stop surface extending outward from the outer peripheral surface of the wheel on the side of the wheel closest to a drive for the chopper.

6. The chopper of claim 5 wherein the orientation of the grooves and ridges are such that the working layer tends to tighten on the wheel due to the direction of rotation of the wheel during operation.

7. The chopper of claim 6 wherein the stop surface is continuous around the wheel.

8. A chopper for continuously separating long lengths of unwound item(s) selected from the group consisting of fibers, fiber strands, string, yarn, wire, tape and ribbon into short pieces as the unwound items pass into the chopper at speeds exceeding 1000 ft./minute comprising a rotatable backup roll having a continuous, elastomer peripheral working layer on an outer peripheral surface of a wheel and a rotatable blade roll comprising a plurality of straight blades for contacting the peripheral working layer of the backup roll, the backup roll mounted on a spindle that is supported on only one end portion, an end portion closest to a drive for the chopper, the improvement comprising; spaced apart spiral grooves or ridges on the outer peripheral surface of the wheel and spaced apart spiral grooves or ridges on an inner surface of the peripheral working layer matching the pattern of the grooves or ridges on the outer peripheral surface of the wheel, the ridges engaging the grooves as the working layer was threaded into place on the wheel, said grooves on the inner surface of the peripheral working layer extending only part way through a thickness of said peripheral working layer, none of said groves on the inner surface of the peripheral working layer extending to an outer peripheral surface of said peripheral working layer, the grooves and ridges being so arranged that the grooves or ridges, present in or on the inner surface of the elastomer peripheral working layer prior to the peripheral working layer being threaded onto the outer peripheral surface of the wheel, the working layer having been threaded onto the outer surface of said wheel without removing said wheel from said spindle and later, the peripheral working layer can be threaded off of the outer surface of said wheel without removing said wheel from said spindle.

9. The chopper of claim 8 wherein the outer peripheral surface of the wheel has ridges thereon and the inner peripheral surface of the elastomer working layer comprises grooves.

10. The chopper of claim 9 wherein the orientation of the grooves and ridges are such that the working layer tends to tighten on the wheel due to the direction of rotation of the wheel during operation.

11. The chopper of claim 9 wherein the wheel has a stop surface extending outward from the outer peripheral surface of the wheel on the side of the wheel closest to a drive for the chopper.

12. The chopper of claim 11 wherein the stop surface is continuous around the wheel.

13. The chopper of claim 9 Wherein the grooves or ridges begin at one edge of the outer peripheral surface of the wheel and one edge of the inner surface of the peripheral elastomer working layer and end before reaching an opposite edge of the outer peripheral surface of the wheel and an opposite edge of the inner surface of the peripheral elastomer working layer.

14. The chopper of claim 8 wherein the outer peripheral surface of the wheel comprises grooves thereon and the inner peripheral surface of the elastomer working layer has ridges thereon, and wherein the wheel has a stop surface extending outward from the outer peripheral surface of the wheel on the side of the wheel closest to a drive for the chopper.

15. The chopper of claim 14 wherein the orientation of the grooves and ridges are such that the working layer tends to tighten on the wheel due to the direction of rotation of the wheel during operation.

16. The chopper of claim 8 wherein the orientation of the grooves and ridges are such that the working layer tends to tighten on the wheel due to the direction of rotation of the wheel during operation.

17. The chopper of claim 14 wherein the grooves or ridges begin at one edge of the outer peripheral surface of the wheel and one edge of the inner surface of the peripheral elastomer working layer and end before reaching an opposite edge of the outer peripheral surface of the wheel and an opposite edge of the inner surface of the peripheral elastomer working layer.

18. The chopper of claim 16 wherein the wheel has a stop surface extending outward from the outer peripheral surface of the wheel on the side of the wheel closest to a drive for the chopper.

19. The chopper of claim 16 wherein the grooves or ridges begin at one edge of the outer peripheral surface of the wheel and one edge of the inner surface of the peripheral elastomer working layer and end before reaching an opposite edge of the outer peripheral surface of the wheel and an opposite edge of the inner surface of the peripheral elastomer working layer.

20. The chopper of claim 8 wherein the wheel has a stop surface extending outward from the outer peripheral surface of the wheel on the side of the wheel closest to a drive for the chopper.

21. The chopper of claim 8 wherein the grooves or ridges begin at one edge of the outer peripheral surface of the wheel and one edge of the inner surface of the peripheral elastomer working layer and end before reaching an opposite edge of the outer peripheral surface of the wheel and an opposite edge of the inner surface of the peripheral elastomer working layer.

* * * * *